United States Patent [19]

Sims

[11] 4,183,017

[45] Jan. 8, 1980

[54] ALARM BUZZER APPARATUS

[75] Inventor: Claude C. Sims, Orlando, Fla.

[73] Assignee: Marine Resources, Inc., Fern Park, Fla.

[21] Appl. No.: 925,542

[22] Filed: Jul. 13, 1978

[51] Int. Cl.[2] ..... G10K 1/00

[52] U.S. Cl. ..... 340/384 R; 340/388; 340/392

[58] Field of Search ..... 340/384 R, 384 E, 388, 340/392

[56] References Cited

U.S. PATENT DOCUMENTS 3,974,499 8/1976 Shigemori ..... 340/388

*Primary Examiner*—Harold I. Pitts

*Attorney, Agent, or Firm*—Duckworth, Hobby & Allen

[57] ABSTRACT

An alarm buzzer for fire alarms, burglar alarms, and the like, is provided using a conventional piezoelectric transducer driven by a battery operated oscillator and mounted in a casing. The casing has a resonance cavity formed therein with the transducer mounted adjacent thereto and having an open end. A grill is mounted to the casing and extends over the resonant cavity and spaced therefrom by a predetermined spacing and a reflector plate is mounted onto the grill covering the grill portion facing the resonant cavity, whereby the efficiency of an alarm buzzer is increased by the combination of a resonance cavity and folded horn.

10 Claims, 3 Drawing Figures

ALARM BUZZER APPARATUS

BACKGROUND OF THE INVENTION

The present invention relates to alarm buzzers and especially to alarm buzzers for use with fire alarms, burglar alarms, and the like.

In the past, it has been conventional to make inexpensive alarms, such as electrical buzzers, for use in a wide variety of products, including smoke alarms, fire alarms, burglar alarms, and typically, these alarms are operated by small batteries, such as a nine (9) volt battery, which operates an oscillator or vibrator which drives a transducer. In one typical prior art alarm buzzer, a piezoelectric transducer is utilized mounted in a casing and driven by an oscillator to produce an alarm when actuated. Alarm buzzers of this type have generally been able to produce a sound pressure level of approximately eighty (80) decibels when measured at ten (10) feet in front of the alarm buzzer. The level of response can be increased by using a larger voltage in a larger battery, but in most alarm actuated devices, it is desirable to have a compact alarm buzzer operated by a small battery or pack of batteries. Prior art alarm buzzers have operated satisfactorily, but it has been felt that a higher sound pressure level is desirable. The present invention is directed towards increasing the efficiency of a buzzer alarm to improve the sound pressure level, utilizing the same voltage source and transducer, thereby allowing the unit to fit into conventional alarm systems without greatly increasing the cost of the buzzers and of the alarms.

SUMMARY OF THE INVENTION

The present invention relates to an alarm buzzer suitable for a fire alarm, burglar alarm, smoke alarm, or the like, and has a casing having a resonant cavity formed therein, with side walls and an open end. A transducer, such as a piezoelectric bender transducer, is mounted to the casing adjacent the resonant cavity and an oscillator is operatively coupled thereto for actuating the transducer. A grill is attached to the casing and extends over the resonant cavity open end, but is spaced from the cavity walls. The grill has a reflector plate mounted thereto covering a portion of the openings in the grill and extending over the resonant cavity, so that the buzzer is formed with a resonant cavity and folded horn to increase the sound pressure level emanating therefrom.

BRIEF DESCRIPTION OF THE DRAWINGS

Other objects, features and advantages of the present invention will be apparent from the written description and the drawings, in which.

DESCRIPTION OF THE PREFERRED EMBODIMENT

Figure 1:
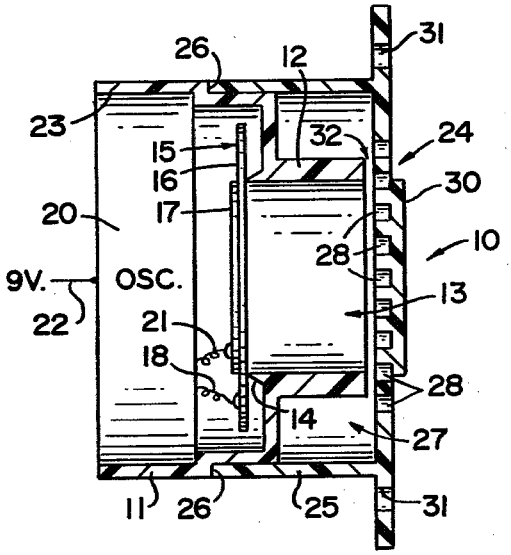
FIG. 1 is a sectional view of an alarm buzzer in accordance with a preferred embodiment of the present invention.
Figure 2:
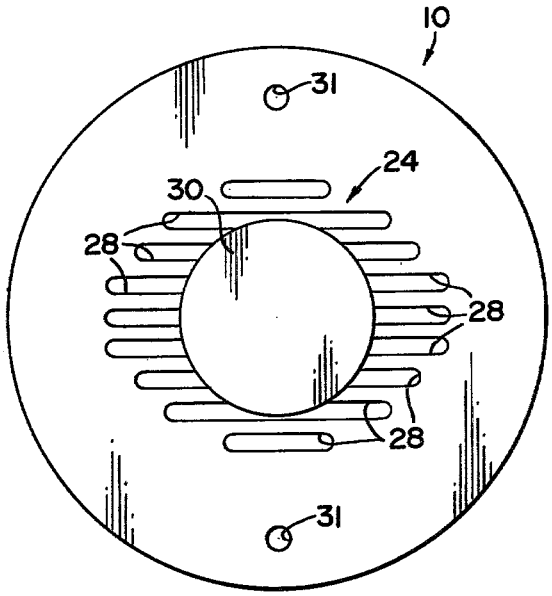
FIG. 2 is a front elevation of the alarm buzzer in accordance with FIG. 1.
Figure 3:
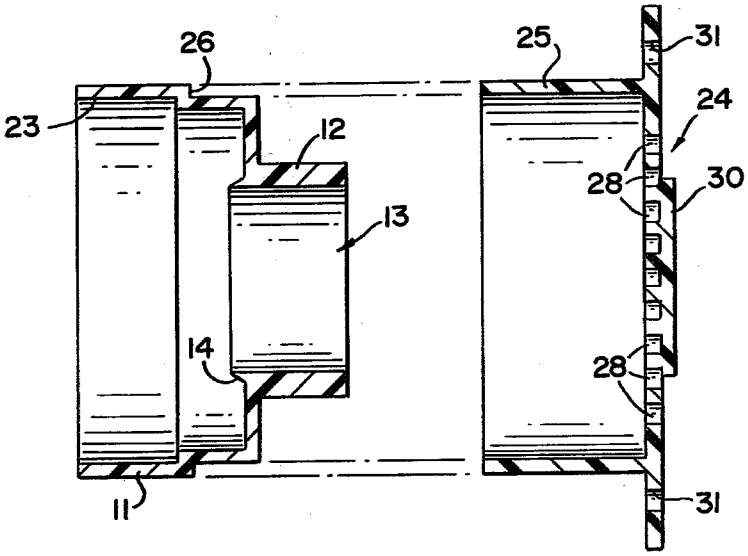
FIG. 3 is an exploded sectional view of the casing and grill for the buzzer alarm of FIGS. 1 and 2.

Referring now to the drawings, an alarm buzzer 10 is illustrated having a main casing 11 formed with protruding resonant cavity walls 12 extending from the front thereof and having an open end 13. The casing 11 is cylindrical, as is the resonant cavity wall 12, and an annular protruding transducer mounting portion 14 extends from the back of the resonant cavity 12 and has a piezoelectric bender transducer 15 mounted thereon having a brass disc 16 with a piezoelectric ceramic member 17 fixedly attached thereto, with the disc 16 having an electrical conductor 18 connected thereto from an oscillator 20, while the ceramic member 17 has an electrical conductor 21 connected thereto from the oscillator 20. A nine (9) volt connecting line 22 is shown connected to the oscillator 20, which is mounted in a cavity 23 formed in the casing 11. The transducer 15 is a conventional piezoelectric bender transducer which has been used for many years in the industry, and oscillator 20 is a 2.9 kilohertz oscillator of conventional design driven by a nine (9) volt battery through the line 22.

The improvement to the present invention results in the forming of the resonance cavity 12 of a predetermined size and shape, and to the grill 24 which is mounted over the open end 13 of the cavity 12. The grill 24 has a cylindrical mounting wall 25 for mounting it to an annular ledge 26 on the casing 11, thereby sealing an annular space 27 between the walls of the resonant cavity 12 and to the walls 25, except for the slotted openings 28 in the grill 24. The slotted openings 28 are partially covered with a reflector plate 30 mounted thereto, and may be formed with the grill 24 as one integral unit. The grill 24 has a pair of apertures 31 for mounting the entire assembly to a smoke alarm, fire alarm, burglar alarm, or the like. The cavity 12 is a cavity of predetermined diameter, such as 0.875 inches, and of predetermined length, such as 0.394 inches, and is formed in front of the transducer 15 and has a front grill extending in front thereof and spaced by a space 32 which could be, for instance, 0.0625 inches, and which is controlled by the length of the wall 25 and the annular niched surface 26. The reflector plate 30 is generally designed to exactly cover the openings in the grill 28 located directly in front of the opening in the cavity 12, and might be 0.88 inches in diameter. Thus, a resonant cavity 12 is formed, as is a folded horn, and the only direct escape for the sound pressure is through the opening 32 to radiate from the openings 28 of the grill 24, which extend around the opening of the cavity 12. The reflector plate 30 is mounted so as to leave the grill spacings 28 extending thereunder, which allows additional escape of the energy, and since the walls 25 seal the areas 27, a folding horn arrangement is created.

The measured response of a unit in accordance with this design has been shown to exceed eighty-five (85) decibels rms sound pressure level at ten (10) feet in front of the alarm buzzer with an rms applied voltage of 4.7 volts and 4.5 milliamps, and can increase the output of conventional units by as much as seven (7) to ten (10) decibels utilizing the same transducer and oscillator driver. The casing 11 can be made of any hard plastic, as can the grill 24 and reflector plate 30, and might typically be made of an ABS type polymer which can be injection molded and the grill can be connected to the casing with an adhesive if desired. Accordingly, the present invention is not to be construed as limited to the embodiment described, which is to be considered illustrative, rather than descriptive.

I claim:

1. An alarm buzzer consisting in combination:

a casing having a resonance cavity formed therein, said cavity having side walls and an open end;

a transducer mounted to said casing adjacent said resonant cavity;

an oscillator operatively coupled to said transducer for actuation thereof;

a grill attached to said casing and extending over said casing resonance cavity open end and being spaced from said side walls thereof; and a reflector plate covering at least a portion of said grill extending over said resonance cavity, whereby an alarm buzzer is formed with a resonance cavity folded horn to increase the level of response therefrom.

2. The alarm buzzer in accordance with claim 1, in which said reflector plate is mounted to said grill to cover substantially the open end of said resonant cavity.

3. The alarm buzzer in accordance with claim 2, in which said grill has a plurality of slots therein with said reflector plate mounted thereon for covering the center portion of said slots.

4. The alarm buzzer in accordance with claim 3, in which the portion of said grill slots extending past said open ends of said resonant cavity are open to the atmosphere.

5. The apparatus in accordance with claim 4, in which said grill has a cylindrical wall extending therefrom, said cylindrical wall being attached to said casing.

6. The apparatus in accordance with claim 5, in which said grill cylindrical walls form an annular cavity around said resonant cavity and open to the atmosphere through said slots in said grill.

7. The apparatus in accordance with claim 6, in which said casing and said grill are made of a hard moldable polymer material.

8. The apparatus in accordance with claim 7, in which said grill is spaced from said resonant cavity side walls by approximately 0.125 inches.

9. The apparatus in accordance with claim 8, in which said casing has an annular surface and an annular niche formed thereon for receiving said annular walls extending from said grill for positioning said grill over said open end of said resonant cavity.

10. The apparatus in accordance with claim 9, in which said casing has a cavity formed therein for mounting said oscillator therein.

* * * * *